US005840403A

United States Patent [19]

Trokhan et al.

[11] Patent Number: 5,840,403

[45] Date of Patent: Nov. 24, 1998

[54] MULTI-ELEVATIONAL TISSUE PAPER CONTAINING SELECTIVELY DISPOSED CHEMICAL PAPERMAKING ADDITIVE

[75] Inventors: Paul Dennis Trokhan, Hamilton; Dean Van Phan, West Chester; Joe Brian Melvin, Cincinnati, all of Ohio

[73] Assignee: The Procter & Gamble Company, Cincinnati, Ohio

[21] Appl. No.: 664,468

[22] Filed: Jun. 14, 1996

[51] Int. Cl.[6] ..... D21H 21/22; B32B 3/00

[52] U.S. Cl. ..... 428/154; 428/156; 428/195; 428/172; 428/165; 162/113; 162/123; 162/127; 162/134; 162/158; 162/162; 162/164.4; 162/168.4; 442/97; 442/102; 442/118; 442/119; 442/152; 442/130

[58] Field of Search ..... 162/127, 113, 162/134, 158, 164.4, 164.6, 164.7, 168.4, 184; 442/412, 414, 417, 97, 102, 152, 165, 118, 119; 428/195, 154, 156, 172, 165

[56] References Cited

U.S. PATENT DOCUMENTS

| | | | |
|---|---|---|---|
| Re. 32,649 | 4/1988 | Brandt et al. | 604/368 |
| 3,369,700 | 2/1968 | Nelson | 221/63 |
| 3,554,788 | 1/1971 | Fechillas | 117/140 |
| 3,670,731 | 6/1972 | Harmon | 128/284 |
| 3,721,242 | 3/1973 | Krusko | 128/287 |
| 3,755,220 | 8/1973 | Freimark et al. | 260/17.3 |
| 3,849,173 | 11/1974 | Drelich et al. | 117/62.1 |
| 3,881,632 | 5/1975 | Early et al. | 221/50 |
| 3,965,904 | 6/1976 | Mesek et al. | 128/284 |
| 3,993,820 | 11/1976 | Repke | 428/167 |
| 4,008,353 | 2/1977 | Gross et al. | 428/522 |
| 4,061,846 | 12/1977 | Gross et al. | 526/16 |
| 4,071,650 | 1/1978 | Gross | 428/260 |
| 4,082,878 | 4/1978 | Roe et al. | 428/195 |
| 4,145,464 | 3/1979 | McConnell et al. | 428/171 |
| 4,235,237 | 11/1980 | Mesek et al. | 128/284 |
| 4,293,600 | 10/1981 | Fink et al. | 427/385.5 |
| 4,310,593 | 1/1982 | Gross | 428/290 |
| 4,354,487 | 10/1982 | Oczkowski et al. | 128/156 |
| 4,460,642 | 7/1984 | Errede et al. | 428/283 |
| 4,529,480 | 7/1985 | Trokhan | 162/109 |
| 4,559,050 | 12/1985 | Iskra | 604/368 |
| 4,699,823 | 10/1987 | Kellenberger et al. | 428/219 |
| 4,715,918 | 12/1987 | Lang | 156/273.1 |
| 4,735,738 | 4/1988 | Willman | 252/90 |
| 4,748,076 | 5/1988 | Saotome | 428/224 |
| 4,761,322 | 8/1988 | Raley | 428/198 |
| 4,820,294 | 4/1989 | Morris | 604/383 |
| 4,835,020 | 5/1989 | Itoh et al. | 427/389.9 |
| 4,842,927 | 6/1989 | Itoh et al. | 428/254 |
| 4,865,886 | 9/1989 | Itoh et al. | 427/342 |
| 4,880,419 | 11/1989 | Ness | 604/368 |
| 4,888,238 | 12/1989 | Katz et al. | 428/378 |
| 4,892,754 | 1/1990 | Itoh et al. | 427/54.1 |
| 4,994,053 | 2/1991 | Lang | 604/367 |
| 5,013,309 | 5/1991 | Baigas, Jr. et al. | 604/368 |
| 5,071,681 | 12/1991 | Manning et al. | 427/392 |
| 5,079,034 | 1/1992 | Miyake et al. | 427/45.1 |
| 5,118,376 | 6/1992 | Pigneul et al. | 156/219 |
| 5,149,335 | 9/1992 | Kellenberger et al. | 604/372 |
| 5,156,902 | 10/1992 | Pieper et al. | 428/206 |
| 5,171,391 | 12/1992 | Chmielewski et al. | 156/229 |
| 5,175,046 | 12/1992 | Nguyen | 428/198 |
| 5,242,435 | 9/1993 | Murji et al. | 604/374 |
| 5,281,207 | 1/1994 | Chmielewski et al. | 604/378 |
| 5,328,759 | 7/1994 | McCormack et al. | 428/283 |
| 5,487,736 | 1/1996 | Van Phan | 604/368 |
| 5,494,731 | 2/1996 | Fereshtehkhou et al. | 428/211 |
| 5,525,345 | 6/1996 | Warner et al. | 424/402 |
| 5,547,747 | 8/1996 | Trokhan et al. | 428/320.2 |
| 5,549,928 | 8/1996 | Trokhan et al. | 427/265 |

FOREIGN PATENT DOCUMENTS

| | | |
|---|---|---|
| 0033988 A2 | 8/1981 | European Pat. Off. . |
| 0040087 A2 | 11/1981 | European Pat. Off. . |
| 0 160 572 A2 | 11/1985 | European Pat. Off. . |
| 0257308 A2 | 3/1988 | European Pat. Off. . |
| 0262405 A2 | 4/1988 | European Pat. Off. . |
| 0 291 316 A2 | 11/1988 | European Pat. Off. . |
| 0290814 A2 | 11/1988 | European Pat. Off. . |
| 0293762 A2 | 12/1988 | European Pat. Off. . |
| 0304952 A2 | 3/1989 | European Pat. Off. . |
| 2 222 780 | 11/1973 | Germany . |
| 63-291908 | 11/1988 | Japan . |
| 1452325 | 10/1976 | United Kingdom . |
| WO 95/35411 | 12/1995 | WIPO . |
| WO 96/19616 | 6/1996 | WIPO . |

*Primary Examiner*—William Krynski

*Assistant Examiner*—J. M. Gray
*Attorney, Agent, or Firm*—Bart S. Hersko; Larry L. Huston; E. Kelly Linman

[57] ABSTRACT

A chemically enhanced paper structure having a discrete pattern of a chemical composition is disclosed. The paper structure comprises a cellulose substrate, such as tissue paper. The substrate has a topography comprising at least two different elevations. The chemical composition may include a chemical softener composition or a surface-active composition and is selectively disposed in register with one of the elevations of the cellulose substrate, preferably the higher elevation regions. The paper structure is suitable for use as bath tissue or facial tissue.

29 Claims, 2 Drawing Sheets

MULTI-ELEVATIONAL TISSUE PAPER CONTAINING SELECTIVELY DISPOSED CHEMICAL PAPERMAKING ADDITIVE

FIELD OF THE INVENTION

This invention relates to a chemically enhanced paper structure comprising a cellulose substrate and a chemical papermaking additive. More particularly, this invention relates to a cellulose substrate containing micro-regions having at least two different elevations. The chemical papermaking additive is incorporated in register with one of the different elevations of the paper structure.

BACKGROUND OF THE INVENTION

Consumer products such as toilet tissue, toweling and facial tissue made from cellulosic webs are a pervasive part of modern society. In general, these products need to possess certain key physical properties to be considered acceptable to consumers. While the exact mix of key properties and the absolute value of the individual properties will vary depending on the nature of the product, nonetheless, softness, wet and dry strength, absorbency, and pleasing aesthetic nature are universally desirable properties. Softness is that aspect of the fibrous web that elicits a pleasing tactile response and insures that the product is not harsh or abrasive when it contacts human skin or other fragile surfaces. Strength is the ability of the structure to retain its physical integrity during use. Absorbency is the property of the fibrous structure which allows it to acquire and retain contacted fluids in an acceptable time. Aesthetic nature refers to the psycho-visual response that occurs when the consumer views the product either alone or in the context of the product's surroundings.

The most common method for the manufacture of tissue products is the wet laid papermaking process. In such a process, individual fibers are first suspended in a dilute slurry with water. This slurry is then laid on a foraminous screen to remove a large portion of the water and to form a thin, relatively uniform-weight embryonic web. This embryonic web is then molded and/or dried in a variety of ways to form the final tissue web. As part of this process the molded and/or dried web is usually glued to a drying drum and subsequently creped from the surface of the dryer to impart desirable properties.

Products made by many existing wet laid processes fall under the above description. Examples of such webs that are soft, strong, and absorbent and contain at least two micro regions of elevation can be found in, U.S. Pat. Nos.: 3,301,746 which issued Jan. 31, 1967, to Lawrence H. Sanford and James B. Sisson; 3,974,025 which issued Aug. 10, 1976, to Peter G. Ayers; 3,994,771 which issued Nov. 30, 1976, to George Morgan, Jr. and Thomas F. Rich; 4,191,609 which issued Mar. 4, 1980, to Paul D. Trokhan; and 4,637,859 which issued Jan. 20, 1987, to Paul D. Trokhan. Each of these papers is characterized by a repeating pattern of high elevation areas and low elevation areas. The elevation areas can be either discrete or continuous. The low elevation areas result from localized compaction of the web during papermaking by raised areas of an imprinting carrier fabric or belt.

Other high-bulk, soft tissue papers are disclosed in U.S. Pat. No. 4,300,981 which issued Nov. 17, 1981, to Jerry E. Carstens; and 4,440,597 which issued Apr. 3, 1984, to Edward R. Wells and Thomas A. Hensler.

Chemically enhanced paper structures comprising a cellulose substrate and having chemical enhanced features applied thereto are known in the art. For example, achieving high-bulk, soft and absorbent tissue paper through the avoidance of overall compaction in combination with the use of debonders and elastomeric bonders in the papermaking furnish is disclosed in U.S. Pat. No. 3,812,000 which issued May 21, 1974, to J. L. Salvucci, Jr.

Chemical debonders such as those contemplated by Salvucci, referred to above, and their operative theory are disclosed in such representative U.S. Pat. Nos. as 3,755,220 which issued Aug. 28, 1973, to Friemark et al.; 3,844,880 which issued Oct. 29, 1974, to Meisel et al.; and 4,158,594 which issued Jan. 19, 1979, to Becker et al.

Tissue paper has also been treated with cationic surfactants, as well as noncationic surfactants to enhance softness. See, for example, U.S. Pat. No. 4,959,125 which issued Sep. 25, 1990, to Spendel; and U.S. Pat. No. 4,940,513 which issued Jul. 10, 1990, to Spendel, that disclose processes for enhancing the softness of tissue paper by treating it with noncationic, preferably nonionic, surfactants.

It has been found that the softness of tissue paper, in particular, high-bulk pattern densified tissue papers, can be improved by treatment with various agents such as vegetable, animal or synthetic oils, and especially polysiloxane materials typically referred to as silicone oils. See, for example, U.S. Pat. No. 5,059,282 which issued Oct. 22, 1991, to Ampulski et al. The Ampulski patent discloses a process for adding a polysiloxane compound to a wet tissue web (preferably at a fiber consistency of between about 20% and about 35%). These polysiloxane compounds impart a silky, soft feeling to the tissue paper.

While the processes described above generally make acceptable product properties, the product properties can be further enhanced. However, processes to make current products and potentially enhanced products suffer from several drawbacks. For example, the chemicals used to strengthen tissue webs are often added to the dilute slurry of water and fibers prior to the initial lay down on the forming screen. This is a relatively convenient and cost effective way to introduce additives. However, other chemicals to aid absorbency or to improve softness are also commonly added to the so called wet end of the tissue making process. Because of the complex nature of the individual chemicals used to generate the key properties, they often interact with each other in an adverse manner. They can compete with each other for the desired retention on the cellulose fibers as well as destroy properties that are inherent in the fibers. For example softening chemicals often reduce the natural tendency of fibers to bond to other fibers and hence reduce the functional strength of the resulting web. Both the process and the product benefit if the chemical papermaking additives introduced in the wet end are kept to a minimum.

Additives introduced in the wet end of the process must be retained by the cellulose fibers if the chemicals are to be functional. This is generally done by using chemicals that possess an ionic charge; most preferably a positive ionic charge which is attracted to the inherent negative ionic charge of cellulose. Many additives which could improve the properties of the web are not charged. Introduction of such chemicals into the dilute fiber slurry at the wet end of the process results in poor retention and exacerbates the interference problems described above.

Examples of patents that disclose processes for adding strength and softness agents to the wet end of the papermaking process include U.S. Pat. Nos. 5,223,096 which issued Jun. 29, 1993 to Phan and Trokhan, and 5,217,576 which issued Jun. 8, 1993 to Phan. These wet end processes typically result in a uniform addition of the strength and softening agents to the tissue paper, and thus, will not prevent any potential undesirable interaction of the chemicals.

Another drawback to adding any chemical to the wet end of the process is that the chemical, if retained, is distributed throughout the web. In many instances it is desirable to apply active ingredient(s) only to the surface of the web. This may, for instance, be desirable with lubricious softening materials. Application only to the surface insures efficient use of the material since consumers only tactilely interact with the surface. Application to the surface also avoids interference with other materials, such as strength additives, that might best be included in the center of the sheet.

The chemical papermaking additives can also be added to the cellulose substrate subsequent to formation of the wet web. For example, the chemical additives may be applied to the cellulose substrate from an aqueous chemical solution, then dried to form a chemically enhanced paper structure. Unfortunately, previous methods of adding chemicals to a cellulose substrate result in a uniform or homogeneous distribution of the chemicals on the substrate. This uniform or homogeneous distribution of chemicals can negate many of the performance advantages offered by cellulose substrates containing at least two micro-regions of elevation.

The present invention overcomes all of the above mentioned drawbacks and generates desirable additional benefits. In particular, it has been found that the addition of functional chemicals in register with the micro-regions of the cellulose substrate can maximize the performance advantages of multi-region paper. For example, as will be discussed in detail hereinafter, chemical softeners are optimally added to the high elevation micro-regions of the web to further enhance that function.

Typically, the chemical composition is applied to the cellulose substrate by spraying or printing. Unfortunately, it is difficult to spray the chemical composition onto the substrate in a precise pattern. Printing the chemical composition onto the substrate may result in a pattern having greater definition and precision than obtainable by spraying, but requires a printing roll having raised protuberances or gravure cells. Printing rolls having raised protuberances and gravure plates limit the pattern of the applied chemical composition to that pattern corresponding to the protuberances of the printing roll or the gravure plates, regardless of which pattern may be desirable for a particular capillary substrate. Also, it can be very difficult to register the printed pattern with the micro-regions of the substrate.

This problem may be overcome by providing a plethora of printing rolls and gravure plates, one for each desired pattern. However, such provision increases the expense of the apparatus to a point where it may not be economically feasible to provide a printing roll or a gravure plate for each desired pattern if only a short production run is desired.

Accordingly, it would be desirable to be able to chemically enhance predetermined micro-regions of tissue paper, in particular high bulk, pattern densified tissue papers, by a process that: (1) can be carried out in a commercial papermaking system without significantly impacting on machine operability; (2) uses chemical compositions that are nontoxic and environmently friendly; and (3) can be carried out in a manner so as to maintain desirable tensile strength, absorbency and low lint properties of the tissue paper.

Importantly, by adding functional chemicals in register with desired micro-regions in accordance with teachings of the present invention, the desired functional property can be enhanced without adveresly affecting other properties. For example, tensile strength can be increased without negatively impacting softness; or, alternatively, softness can be improved without negatively impacting tensile strength.

It is an object of this invention to provide soft, absorbent toilet tissue paper products.

It is an object of this invention to provide soft, absorbent facial tissue paper products.

It is an object of this invention to provide soft, absorbent paper towel products.

It is an object of the present invention to provide a paper structure, such as a tissue web, comprising a cellulose substrate containing at least two micro-regions of elevation, wherein chemical papermaking additives are incoporated in register with the micro-regions of the paper structure.

It is a further object of this invention to provide an improved process to incorporate chemical papermaking additives into the tissue web that enhance softness, strength, absorbency, and aesthetics or combinations of these properties.

It is a further object of this invention to provide an improved process to incorporate chemical papermaking additives in register with the micro-regions of the tissue web to maximize the performance advantages of multi-region paper.

These and other objects are obtained using the present invention, as will be seen from the following more detailed disclosure.

SUMMARY OF THE INVENTION

The invention is a chemically enhanced paper structure comprising a cellulose substrate having a least two elevations, a first elevation defining a first pattern, and a second elevation comprising a second pattern. Each elevation comprises one or more regions of the cellulosic substrate. An immobilized chemical papermaking additive is disposed on one or more of the regions corresponding to one of the elevations of the cellulosic substrate.

In a particularly preferred embodiment, the higher of said elevations corresponds to discrete regions and the lower of said elevations corresponds to an essentially continuous network. In this embodiment, the immobilized chemical papermaking additive is preferably disposed, for example, on the discrete high elevation regions if it is intended to improve softness and/or absorbency. Likewise, the immobilized chemical papermaking additive can be added to the continuous low elevation regions if it is intended, for example, to improve strength. In addition, as will be discussed in detail hereinafter, the chemically enhanced paper structure of the present invention is preferably through-air-dried.

BRIEF DESCRIPTION OF THE DRAWINGS

While the Specification concludes with claims particularly pointing out and distinctly claiming the present invention, it is believed the present invention will be better understood from the following description taken in conjunction with the accompanying drawings in which:

DETAILED DESCRIPTION OF THE INVENTION

Figure 1:
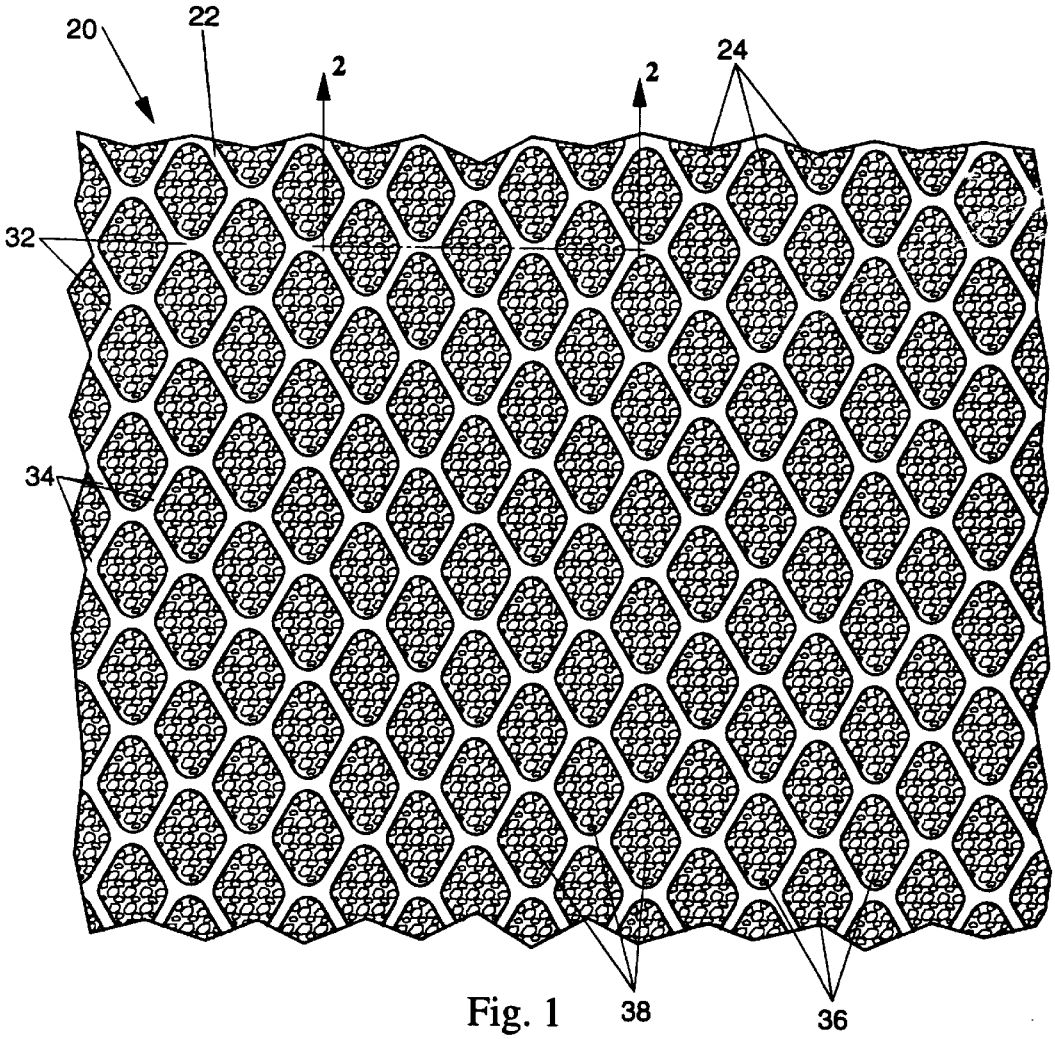
FIG. 1 is a fragmentary top plan view of an paper structure according to the present invention having a continuous cellulose network and discrete sites of a chemical papermaking additive therein.
Figure 3:
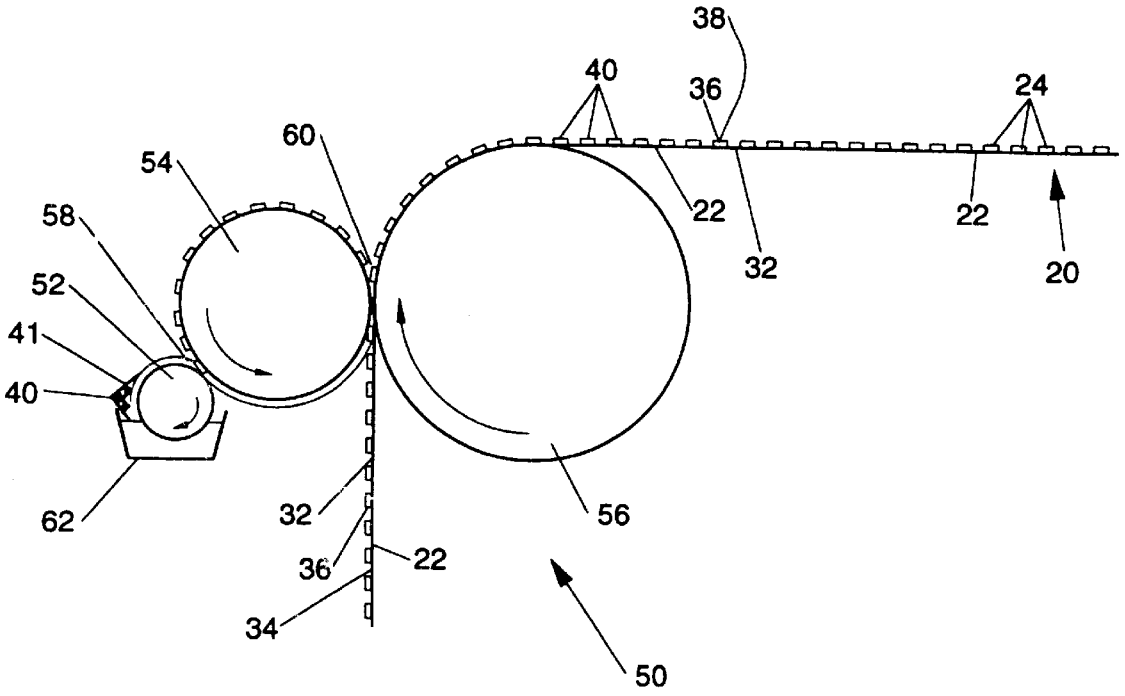
FIG. 3 is a schematic vertical elevational view of one apparatus which may be used to produce the structure of the present invention.

As illustrated in FIG. 1, a chemically enhanced paper structure 20 according to the present invention comprises a generally planar cellulose substrate 22 and a chemical papermaking additive 24. The chemical papermaking additive 24 is applied to the cellulose substrate 22, typically in the form of a aqueous solution 40 as shown in FIG. 3. Referring to FIG. 3, the aqueous solution 40 is applied to the cellulose substrate 22 in a particular pattern. Once the aqueous solution 40 is disposed on the cellulose substrate 22, the water is ultimately removed by drying, with the chemical papermaking additive 24 remaining on the cellulose substrate.

Referring back to FIG. 1, the cellulose substrate 22 is a cellulose structure, preferably a tissue paper web. The cellulose substrate 22 comprises multiple micro-regions 34 and 38 having different basis weights and/or densities. Any arrangement of regions 34 and 38 in the cellulose substrate 22 is acceptable, so long as the cellulose substrate 22 is macroscopically planar and the chemical papermaking additive 24 may be immobilized in register with one of the micro-regions.

The cellulose substrate 22 according to the present invention has distinguishable micro-regions 34 and 38 defining two mutually different densities. Preferably, the regions 34 and 38 are disposed in an arrangement comprising an essentially continuous network region 32 and discrete regions 36 within the essentially continuous network. As used herein, a region 32 which extends substantially throughout the cellulose substrate 22 in one or both of the principal dimensions is considered to be "an essentially continuous network." Conversely, regions 36 which are not contiguous, are considered to be "discrete." The discrete regions 36 project outwardly to a distal end from the region 32 defining the essentially continuous network.

Preferably, the discrete regions 36 and the essentially continuous network region 32 are disposed in a nonrandom, repeating pattern. By being "nonrandom" the regions 32 and 36 are considered to be predictable and may occur as a result of known and predetermined features of the manufacturing process. By "repeating", the pattern is formed more than once in the cellulose substrate 22. However, it is to be understood that if the cellulose substrate 22, as presented to the consumer, is relatively small and the pattern is relatively large or the paper structure 20 is presented to the consumer as an integral unit, the pattern may appear to occur only once in the cellulose substrate 22. More preferably the regions 34 and 38 of the cellulose substrate 22 are disposed in an arrangement having a high density essentially continuous network region 32 and discrete low density regions 36 within the essentially continuous network region 32. Preferably, the discrete low density regions 36 and the essentially continuous network region 32 lie in a different plane, as will be discussed hereinafter.

For the embodiments described herein, a cellulose substrate 22 having about 2 to about 155 low density discrete regions 36 (preferably with chemical papermaking additive 24 thereon) per square centimeter (10 to 1000 discrete regions 36 per square inch) and more particularly, about 16 to about 109 low density discrete regions 36 per square centimeter (100 to 700 discrete regions 36 per square inch) has been found suitable.

The cellulose substrate 22 according to the present invention has a topography which may comprise at least two different elevations 26. The "elevation" of a cellulose substrate 22 is its local deviation from planarity. The elevation 26 of a substrate is determined by laying it on a flat, horizontal surface, which serves as a reference plane. Different elevations 26 of the cellulose substrate 22, which may or may not be coincident with the regions 34 and 38 of differing density described above, are determined by the difference in height above the reference plane, taken orthogonal the reference plane and principal dimensions of the cellulose substrate 22.

Preferably the regions 34 and 38 defined according to differing densities and differing elevations 26 are coincident. Thus the discrete low density regions 36 are also raised in elevation 26 (or lowered in elevation 26 if the cellulose substrate 22 is inverted) from the high density regions 34 of the essentially continuous network region 32. However, it is to be recognized that suitable embodiments may exist wherein such discrete regions 36 of a particular density are not coincident with a particular elevation 26.

The cellulose substrate 22 according to the present invention may be comprised of cellulosic fibers having one very large dimension (along the longitudinal axis of the fiber) compared to the other two relatively very small dimensions (mutually perpendicular, and being both radial and perpendicular to the longitudinal axis of the fiber), so that linearity is approximated. While microscopic examination of the fibers may reveal the other two dimensions are small compared to the principal dimension of the fibers, such other two small dimensions need not be substantially equivalent nor constant throughout the axial length of the fiber. It is only important that the fiber be able to bend about its axis, be able to bond to other fibers and be distributed onto a forming wire (or its equivalent) by a liquid carrier.

The cellulose substrate 22 may be creped or be uncreped, as desired. Creping the cellulose substrate 22 foreshortens it producing undulations in the Z-direction throughout the essentially continuous network region 32. Such undulations yield cross machine ripples which are considered too minor to be differences in elevation 26 as compared to the differences in elevation 26 obtainable by the methods described hereinbelow. However, it is to be recognized that a creped cellulose substrate 22 may be embossed, through-air-dried, etc. to produce differences in elevation 26 which are large, relative to the creping undulations and ripples. An example of a method of making an uncreped, through-air dried tissue paper product is described in European Patent Application No. 0 677 612 A2 assigned to Kimberly-Clark Corporation, published Oct. 18, 1995, and incorporated herein by reference. Such uncreped, through-air dried structures are suitable for the practice of this invention.

The fibers comprising the cellulose substrate 22 may be synthetic, such as polyolefin or polyester; are preferably cellulosic, such as cotton linters, rayon or bagasse; and more preferably are wood pulp, such as soft woods (gymnosperms or coniferous) or hard woods (angiosperms or deciduous), may be cross-linked, and may comprise combinations of synthetic and cellulosic materials. As used herein, a cellulose substrate 22 is considered "cellulosic" if the cellulose substrate 22 comprises at least about 50 weight percent or at least about 50 volume percent cellulosic fibers, including but not limited to those fibers listed above. A cellulosic mixture of wood pulp fibers comprising softwood fibers having a length of about 2.0 to about 4.5 millimeters and a diameter of about 25 to about 50 micrometers, and hardwood fibers having a length of less than about 1 millimeter and a diameter of about 12 to about 25 micrometers has been found to work well for the cellulose substrates 22 described herein.

If wood pulp fibers are selected for the cellulose substrate 22, the fibers may be produced by any pulping process including chemical processes, such as sulfite, sulfate and soda processes; and mechanical processes such as stone groundwood. Alternatively, the fibers may be produced by combinations of chemical and mechanical processes or may be recycled. The type, combination, and processing of the fibers used are not critical to the present invention.

A cellulose substrate 22 according to the present invention is macroscopically two-dimensional and planar, having some thickness in the third dimension. However, the thickness in the third dimension is relatively small compared to the first two dimensions or to the capability to manufacture a cellulose substrate 22 having relatively large measurements in the first two dimensions.

The cellulose substrate 22 according to the present invention comprises a single lamina and may be layered or stratified as to fiber type. However, it is to be recognized that two or more single laminae, any or all made according to the present invention, may be joined in face-to-face relation to form a unitary laminate.

Of course, it is to be recognized that a woven or nonwoven material may be adequately utilized as a cellulose substrate 22, providing it meets the density requirements specified above.

A cellulose substrate 22 having regions 34 and 38 of different densities may be achieved by locally densifying certain areas through embossing as is well known in the art, or by dedensifying certain areas by vacuum or pressure deflection into a suitable mold followed by through-air drying as is well known in the art. Similarly, a cellulose substrate 22 having different elevations 26 in the direction generally normal to the plane of the cellulose substrate 22 may be accomplished by embossing as is well known in the art, or again accomplished by vacuum or pressure deflection into a suitable mold followed by through-air drying as is well known in the art.

Preferably, the chemically enhanced paper structure of the present invention is through-air-dried. A particularly preferred through-air dried cellulose substrate 22 is produced in accordance with commonly assigned U.S. Pat. No. 4,529,480 issued Jul. 16, 1985 to Trokhan, which patent is incorporated herein by reference for the purpose of showing a through-air-dried cellulose substrate 22 having discrete regions 36 and an essentially continuous pattern region 32 and for the purpose of showing how to make a particularly preferred cellulose substrate 22 according to the present invention having different elevations 26. A cellulose substrate 22 made according to U.S. Pat. No. 4,529,480 issued to Trokhan has mutually coincident discrete regions 36, which regions 36 are both relatively low in density and raised (or lowered) in elevation 26.

The cellulose substrate 22 preferably has a difference in elevation 26 between the different regions 34 and 38 of at least about 0.13 millimeters (0.005 inches). The elevation 26 is measured without a confining pressure, using microtomoscopy or stereoscopic three-dimensional scanning electron microscopy imaging, as are well known in the art.

The chemical papermaking additive 24 may be applied to the cellulose substrate in an aqueous solution, emulsion, suspension, etc. For example, an aqueous solution 40 containing the chemical papermaking additive 24, can be applied to the cellulose substrate 22 as illustrated in FIG. 3.

The specific type of chemical papermaking additive 24 is not critical to the invention, so long as the chemical papermaking additive 24 may be applied in the desired pattern, and immobilized, so that it does not flow, migrate, or otherwise transport to different parts of the cellulose substrate 22 and transmogrify the desired pattern into a less useful disposition of the chemical papermaking additive 24 (such as a uniform coating). The chemical papermaking additive 24 is preferably immobilized in both the dry condition and while wetted in use.

Figure 2:
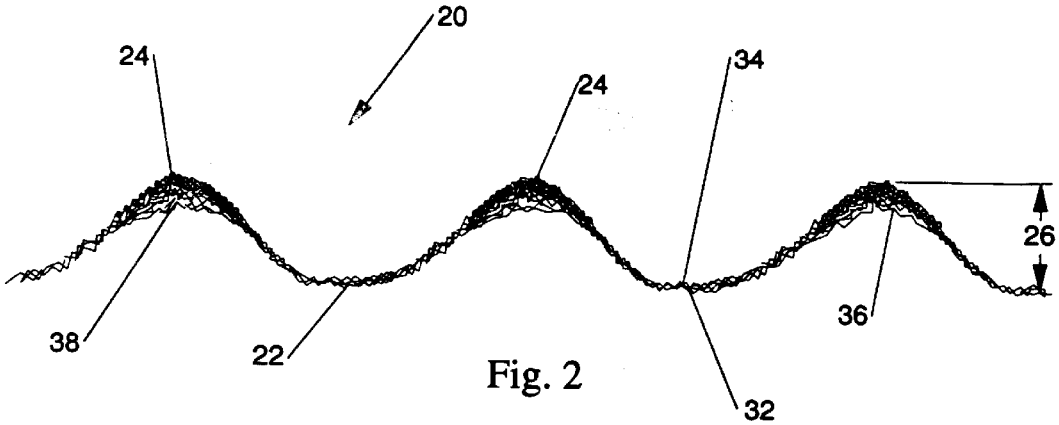
FIG. 2 is a fragmentary side elevational view taken along line 2—2 of FIG. 1.

Referring to FIG. 2, the chemical papermaking additive 24 is preferably disposed upon, registered with, and immobilized at the discrete low density regions 38 of the cellulose substrate 22 in a particular predetermined pattern. Although other patterns, such as semicontinuous patterns which form lines extending throughout substantially only one principal dimension of the cellulose substrate 22 (i.e., the machine direction, the cross machine direction, or diagonals thereof) are possible, a pattern having the chemical papermaking additive 24 disposed on only the discrete low density regions 38 is preferred. In this preferred embodiment, the relatively high density region is substantially free of the immobilized chemical papermaking additive 24.

Referring again to FIG. 3, the chemically enhanced paper structure 20 according to the present invention may be made according to the illustrated apparatus 50. The illustrated apparatus 50 comprises three axially rotatable rolls 52, 54 and 56, preferably having mutually parallel longitudinal axes, a metering roll 52, a transfer roll 54, and an anvil roll 56. The three rolls 52, 54 and 56 form a nip 58 and a gap 60. The nip 58 is between the metering roll 52 and the transfer roll 54. The gap 60 is between the transfer roll 54 and the anvil roll 56.

The metering roll 52 is a gravure roll disposed in a reservoir 62 of the liquid precursor 40. Upon axial rotation, the metering roll 52 acquires liquid precursor 40 from the reservoir 62, precisely levels the fill in the individual cells of the metering roll 52 by means of doctor blade 41 and then transfers a particular quantity of the aqueous solution 40 to the transfer roll 54. The cellulose substrate 22 passes through the gap 60 between the transfer roll 54 having aqueous solution 40 uniformly disposed thereon and the anvil roll 56. Importantly the topographically elevated regions 36 and 38 of the cellulose substrate 22, to which it is desired to apply the aqueous solution 40 containing the chemical papermaking additive 24, project toward and contact the transfer roll 54, with the balance of the cellulose substrate 22 resting against the anvil roll 56. It will be apparent to one skilled in the art that by increasing or decreasing the clearance in the gap 60 between the transfer roll 54 and the anvil roll 56, smaller and larger amounts of the aqueous composition 40 may be printed upon and applied to the topographically elevated regions of the cellulose substrate 22, respectively, upon contact therewith. Likewise, changing the design of the metering roll 52 can alter the amount of aqueous solution 40 applied to the cellulose substrate 22 at a constant gap 60. Alternatively, it will be apparent the aqueous solution 40 may be applied to the transfer roll 54 by spraying, submerging the transfer roll 54 in the aqueous composition 40, etc., and thereby eliminating the necessity for a metering roll 52, or by printing directly from the metering roll 52 to the substrate 22 in the gap 60 formed between the metering roll 52 and the anvil roll 56.

As the cellulose substrate 22 passes through the gap 60 between the transfer roll 54 and the anvil roll 56, aqueous solution 40 is applied to only the regions of the cellulose substrate 22 which have an elevation 26 sufficient to contact the periphery of the transfer roll 54. The transfer roll 54, does not contact the portions of the cellulose substrate 22 which rest against the anvil roll 56. Accordingly, no aqueous solution 40 is applied to these portions of the cellulose substrate 22.

By adjusting the clearance in the gap 60, different quantities of the aqueous solution 40, and ultimately dried chemical papermaking additive 24, may be applied to the elevated regions of the cellulose substrate 22. Generally, for the embodiments described herein, aqueous composition 40 applied in the range of about 1 to about 500 milligrams per square centimeter of discrete region 36 has been found suitable.

Once the cellulose substrate 22 to be utilized in the paper structure 20 is selected based upon consumer preferences, certain benefits become apparent. Particularly, the cellulose substrate 22 according to the present invention, having regions 34 and 38 of different elevations 26 (one region 34 in contact with the anvil roll 56, the other region 38 in contact with the transfer roll 54) provides several advantages not found in the prior art. First, a particular pattern of the aqueous solution 40 containing the chemical papermaking additive 24 may be deposited onto the cellulose substrate 22, without requiring the transfer roll 54 to have a gravure pattern or have radially extending protuberances. Typically, metering rolls 54 having patterns are more difficult and expensive to manufacture, than nonpatterned metering rolls 54.

A second benefit of the claimed invention is the flexibility which allows one who may not wish to use a transfer roll 54 having a pattern, to achieve registration of the pattern with the regions of the cellulose substrate 22 to which it is desired to apply the chemcial papermaking additive 24. Such registration can be extremely difficult to achieve under even ideal manufacturing conditions, as the different regions of the cellulose substrate 22 may occur on near microscopic scale. Actual manufacturing is even more complex, because the pitch of the different regions 32 and 36, and hence the opportunity of misregistration may change with ordinary variations in tension as the cellulose substrate 22 is drawn through the apparatus 50, the basis weight of the cellulose substrate 22, and other manufacturing parameters. Production of the invention by the process described in FIG. 3 ensures exact registration of the chemical papermaking additive 24 with the desired regions of the cellulose substrate 22.

Third, if it is desired to change the pattern of the chemical papermaking additive 24 applied to the cellulose substrate 22, a single apparatus 50 having a transfer roll 54 with a smooth unpatterned periphery may be utilized for multiple patterns. A cellulose substrate 22 having a different topography is inserted in the gap 60 between the transfer roil 54 and anvil roll 56, and the clearance of the gap 60 adjusted as appropriate. The transfer roll 54 may continue to be provided with a smooth surface and any desired pattern achieved by simply changing the cellulose substrate 22. Once a particular cellulose substrate 22 is selected, such flexibility in manufacturing was unattainable in the prior art.

Several variations according to the present invention are feasible. For example, if desired, one may construct a cellulose substrate 22 having an essentially continuous network region 32 and discrete regions 36 which differ according to basis weight rather than density. If such a cellulose substrate 22 is selected, it may be advantageously made using a forming wire according to FIG. 4 of commonly assigned U.S. Pat. No. 4,514,345 issued Apr. 30, 1985 to Johnson et al. or commonly assigned U.S. Pat. No. 5,245,025 issued Sep. 14, 1993 to Trokhan et al., which patents are incorporated herein by reference for the purpose of showing how to make a cellulose substrate 22 having regions which differ according to basis weight. Alternatively, discrete regions 36 having plural different elevations 26 above (or below) the essentially continuous network region 32 are feasible. The chemical composition 24 may be applied to only the discrete regions 36 having a particular minimum elevation 26, or to each of the discrete regions 36 in elevation-dependent quantities.

CHEMICAL PAPERMAKING ADDITIVES

The chemical papermaking additives for use in the multielevational tissue paper of the present invention are preferably selected from the group consisting of strength additives, absorbency additives, softener additives, aesthetic additives, and mixtures thereof. Each of these types of additives will be discussed below.

A) Strength Additives

The strength additive is selected from the group consisting of permanent wet strength resins, temporary wet strength resins, dry strength additives, and mixtures thereof.

If permanent wet strength is desired, the chemical papermaking additive can be chosen from the following group of chemicals: polyamidpichlorohydrin, polyacrylamides, insolubilized polyvinyl alcohol; ureaormaldehyde; polyethyleneimine; and chitosan polymers. Polyamideepichlorohydrin resins are cationic wet strength resins which have been found to be of particular utility. Suitable types of such resins are described in U.S. Pat. Nos. 3,700,623, issued on Oct. 24, 1972, and 3,772,076, issued on Nov. 13, 1973, both issued to Keim and both being hereby incorporated by reference. One commercial source of a useful polyamideepichlorohydrin resins is Hercules, Inc. of Wilmington, Del., which markets such resin under the mark KYMEVE® 557H.

Polyacrylamide resins have also been found to be of utility as wet strength resins. These resins are described in U.S. Pat. Nos. 3,556,932, issued on Jan. 19, 1971, to Coscia, et al. and 3,556,933, issued on Jan. 19, 1971, to Williams et al., both patents being incorporated herein by reference. One commercial source of polyacrylamide resins is American Cyanamid Co. of Stanford, Conn., which markets one such resin under the mark PAREZ® 631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention.

If temporary wet strength is desired, the chemical papermaking additive can be chosen from the following group of chemicals: cationic dialdehyde starch-based resin (such as Caldas produced by Japan Carlet, National Starch 78-0080 or Cobond 1000, both produced by National Starch and Chemical Corporation); and dialdehyde starch. Modified starch temporary wet strength resins are also described in U.S. Pat. No. 4,675,394, Solarek, et al. issued Jun. 23, 1987, and incorporated herein by reference. Preferred temporary wet strength resins include those described in U.S. Pat. No. 4,981,557 issued on Jan. 1, 1991, to Bjorkquist and incorporated herein by reference. Another example of a preferred temporary wet strength resin is PAREZ® 750B, a commercially available modified polyacrylamide resin manufactured by CyTec.

If dry strength is desired, the chemical papermaking additive can be chosen from the following group of chemicals. Polyacrylamide (such as combinations of Cypro 514 and ACCOSTRENGTH 711 produced by American Cyanamid of Wayne, N.J.); starch (such as corn starch or potato starch); polyvinyl alcohol (such as AIRVOL 540 produced by Air Products Inc of Allentown, Pa.); guar or locust bean gums; and/or carboxymethyl cellulose (such as AQUALON CMC-T from Aqualon Co., Wilmington, Del.). In general, suitable starch for practicing the present invention is characterized by water solubility, and hydrophilicity. Exemplary starch materials include corn starch and potato starch, albeit it is not intended to thereby limit the scope of suitable starch materials; and waxy corn starch that is known industrially as amioca starch is particularly preferred. Amioca starch differs from common corn starch in that it is entirely amylopectin, whereas common corn starch contains both amplopectin and amylose. Various unique characteristics of amioca starch are further described in "Amioca - The Starch From Waxy Corn", H. H. Schopmeyer, Food Industries, December 1945, pp. 106–108 (Vol. pp. 1476–1478). The starch can be in granular or dispersed form albeit granular form is preferred. The starch is preferably sufficiently cooked to induce swelling of the granules. More preferably, the starch granules are swollen, as by cooking, to a point just prior to dispersion of the starch granule. Such highly swollen starch granules shall be referred to as being "fully cooked." The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes. Other exemplary starch materials which may be used include modified cationic starches such as those modified to have nitrogen containing groups such as amino groups and methylol groups attached to nitrogen, available from National Starch and Chemical Company, (Bridgewater, N.J.). Such modified starch materials have heretofore been used primarily as a pulp furnish additive to increase wet and/or dry strength. However, when applied in accordance with this invention by application to a tissue paper web they may have reduced effect on wet strength relative to wet-end addition of the same modified starch materials. Considering that such modified starch materials are more expensive than unmodified starches, the latter have generally been preferred. These wet and dry strength resins may be added to the pulp furnish in addition to being added by the process described in this invention. It is to be understood that the addition of chemical compounds such as the wet strength and temporary wet strength resins discussed above to the pulp furnish is optional and is not necessary for the practice of the present development.

The strength additive may be applied to the tissue paper web alone, simultaneously with, prior to, or subsequent to the addition of softener, absorbency, and/or aesthetic additives. At least an effective amount of a strength additive, preferably starch, to provide lint control and concomitant strength increase upon drying relative to a non-binder treated but otherwise identical sheet is preferably applied to the sheet. Preferably, between about 0.01% and about 2.0% of a strength additive is retained in the dried sheet, calculated on a dry fiber weight basis; and, more preferably, between about 0.1% and about 1.0% of a strength additive material, preferably starch-based, is retained.

B) Softener Additives

The chemical softener additives are selected from the group consisting of lubricants, plasticizers, cationic debonders, noncationic debonders and mixtures thereof. Suitable debonders for use as softener additives in the present invention include both cationic and noncationic surfactants, with cationic surfactants being preferred. Noncationic surfactants include anionic, nonionic, amphoteric, and zwitterionic surfactants. Preferably, the surfactant is substantially nonmigratory in situ after the tissue paper has been manufactured in order to substantially obviate post-manufacturing changes in the tissue paper's properties which might otherwise result from the inclusion of surfactant. This may be achieved, for instance, through the use of surfactants having melt temperatures greater than the temperatures commonly encountered during storage, shipping, merchandising, and use of tissue paper product embodiments of the invention: for example, melt temperatures of about 50° C. or higher.

The level of noncationic surfactant applied to tissue paper webs to provide the aforementioned softness/tensile benefit ranges from the minimum effective level needed for imparting such benefit, on a constant tensile basis for the end product, to about 2%: preferably between about 0.01% and about 2% noncationic surfactant is retained by the web; more preferably, between about 0.05% and about 1.0%; and, most preferably, between about 0.05% and about 0.3%. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as CRODESTA® SL-40 which is available from Croda, Inc. (New York, N.Y.); alkylglycoside ethers as described in U.S. Pat. No. 4,011,389, issued to W. K. Langdon, et al. on Mar. 8, 1977; alkylpolyethoxylated esters such as PEGOSPERSE® 200 ML available from Glyco Chemicals, Inc. (Greenwich, Conn.); alkylpolyethoxylated ethers and esters such as NEODOLR 25-12 available from Shell Chemical Co; sorbitan esters such as SPAN 60 from ICI America, Inc, ethoxylated sorbitan esters, propoxylated sorbitan esters, mixed ethoxylated propoxylated sorbitan esters, and polyethoxylated sorbitan alcohols such as TWEEN 60 also from ICI America, Inc. Alkylpolyglycosides are particularly preferred for use in the present invention. The above listings of exemplary surfactants are intended to be merely exemplary in nature, and are not meant to limit the scope of the invention.

Any surfactant other than the chemical papermaking additive emulsifying surfactant material, is hereinafter referred to as "surfactant," and any surfactant present as the emulsifying component of emulsified chemical papermaking additives is hereinafter referred to as "emulsifying agent". The surfactant may be applied to the tissue paper alone or simultaneously with, after, or before other chemical papermaking additives. In a typical process, if another additive is present, the surfactant is applied to the cellulosic substrate simultaneously with the other additive(s). It may also be desirable to treat a debonder containing tissue paper with a relatively low level of a binder for lint control and/or to increase tensile strength. As used herein the term "binder" refers to the various wet and dry strength additives known in the art. The binder may be applied to the tissue paper simultaneously with, after or before the debonder and an absorbency aid, if used. Preferably, binders are added to the tissue webs simultaneously with the debonder (e.g., the binder is included in the dilute aqueous solution applied to the tissue web).

If a chemical softener that functions primarily by imparting a lubricous feel is desired, it can be chosen from the following group of chemicals. Organic materials (such as mineral oil or waxes such as parafin or carnuba, or lanolin); and polysiloxanes (such as the compounds described in U.S. Pat. No. 5,059,282 issued to Ampulski and incorporated herein by reference) Suitable polysiloxane compounds for use in the present invention are described in detail below.

The level of polysiloxane compounds applied to tissue paper webs to provide the aforementioned softness/ lubricous feel benefit ranges from the minimum effective level needed for imparting such benefit, on a constant tensile basis for the end product, to about 2%, by weight on a dry fiber basis: preferably between about 0.01% and about 2% polsiloxane compound is retained by the web; more preferably, between about 0.02% and about 1.0%; and, most preferably, between about 0.03% and about 0.3%. The polysiloxane compounds preferably have monomeric siloxane units of the following structure:

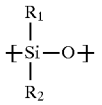

wherein, $R_1$ and $R_2$, for each independent siloxane monomeric unit can each independently be hydrogen or any alkyl, aryl, alkenyl, alkaryl, arakyl, cycloalkyl, halogenated hydrocarbon, or other radical. Any of such radicals can be substituted or unsubstituted. $R_1$ and $R_2$ radicals of any particular monomeric unit may differ from the corresponding functionalities of the next adjoining monomeric unit. Additionally, the polysiloxane can be either a straight chain, a branched chain or have a cyclic structure. The radicals $R_1$ and $R_2$ can additionally independently be other silaceous functionalities such as, but not limited to siloxanes, polysiloxanes, silanes, and polysilanes. The radicals $R_1$ and $R_2$ may contain any of a variety of organic functionalities including, for example, alcohol, carboxylic acid, aldehyde, ketone and amine, amide functionalities, with amino functional silicone compounds being preferred. Exemplary alkyl radicals are methyl, ethyl, propyl, butyl, pentyl, hexyl, octyl, decyl, octadecyl, and the like. Exemplary alkenyl radicals are vinyl, allyl, and the like. Exemplary aryl radicals are phenyl, diphenyl, naphthyl, and the like. Exemplary alkaryl radicals are toyl, xylyl, ethylphenyl, and the like. Exemplary arakyl radicals are benzyl, alpha-phenylethyl, beta-phenylethyl, alpha-phenylbutyl, and the like. Exemplary cycloalkyl radicals are cyclobutyl, cyclopentyl, cyclohexyl, and the like. Exemplary halogenated hydrocarbon radicals are chloromethyl, bromoethyl, tetrafluorethyl, fluorethyl, trifluorethyl, trifluorotoyl, hexafluoroxylyl, and the like. References disclosing polysiloxanes include U.S. Pat. No. 2,826,551, issued Mar. 11, 1958 to Geen; U.S. Pat. No. 3,964,500, issued Jun. 22, 1976 to Drakoff; U.S. Pat. No. 4,364,837, issued Dec. 21, 1982, Pader, U.S. Pat. No. 5,059,282, issued Oct. 22, 1991 to Ampulksi et al.; and British Patent No. 849,433, published Sep. 28, 1960 to Woolston. All of these patents are incorporated herein by reference. Also, incorporated herein by reference is *Silicon Compounds*, pp 181–217, distributed by Petrarch Systems, Inc., 1984, which contains an extensive listing and description of polysiloxanes in general.

If a chemical softener that functions primarily by plasticizing the structure is desired, it can be chosen from the following group of chemicals: polyethylene glycol (such as PEG 400); dimethylamine; and/or glycerine.

If a cationic chemical softener that functions primarily by debonding is desired, it can be chosen from the following group of chemicals. Cationic quaternary ammonium compounds (such as dihydrogenated tallow dimethyl ammonium methyl sulfate (DTDMAMS) or dihydrogenated tallow dimethyl ammonium chloride (DTDMAC) both produced by Witco Corporation of Greenwich, Conn.; Berocel 579 (produced by Eka Nobel of Stennungsund, Sweden); materials described in U.S. Pat. Nos. 4,351,699 and 4,447,294 issued to Osborn and incorporated herein by reference; and/or diester derivitives of DTDMAMS or DTDMAC.) In particular, quaternary ammonium compounds having the formula:

$$(R_1)_{4-m}-N^+-[R_2]_mX^-$$

wherein m is 1 to 3;

each $R_1$ is a $C_1$–$C_8$ alkyl group, hydroxyalkyl group, hydrocarbyl or substituted hydrocarbyl group, alkoxylated group, benzyl group, or mixtures thereof;

each $R_2$ is a $C_9$–$C_{41}$ alkyl group, hydroxyalkyl group, hydrocarbyl or substituted hydrocarbyl group, alkoxylated group, benzyl group, or mixtures thereof; and $X^-$ is any softener-compatible anion are suitable for use in the present invention.

Preferably, each $R_2$ is $C_{16}$–$C_{18}$ alkyl, most preferably each $R_2$ is straight-chain $C_{18}$ alkyl. Preferably, each $R_1$ is methyl and $X^-$ is chloride or methyl sulfate. Optionally, the $R_2$ substituent can be derived from vegetable oil sources.

Biodegradable ester-functional quaternary ammonium compound having the formula:

$$(R_1)_{4-m}—N^+-[(CH_2)_n—Y—R_2]_mX^-$$

wherein each Y=—O—(O)C—, or —C(O)—O—;

m=1 to 3; preferably, m=2;

each n=1 to 4; preferably, n=2;

each $R_1$ substituent is a short chain $C_1$–$C_6$, preferably $C_1$–$C_3$, alkyl group, e.g., methyl (most preferred), ethyl, propyl, and the like, hydroxyalkyl group, hydrocarbyl group, benzyl group or mixtures thereof;

each $R_2$ is a long chain, at least partially unsaturated (IV of greater than about 5 to less than about 100, preferably from about 10 to about 85), $C_{11}$–$C_{23}$ hydrocarbyl, or substituted hydrocarbyl substituent and the counter-ion, $X^-$, can be any softener-compatible anion, for example, acetate, chloride, bromide, methylsulfate, formate, sulfate, nitrate and the like can also be used in the present invention.

Preferably, the majority of $R_2$ comprises fatty acyls containing at least 90% $C_{18}$–$C_{24}$ chainlength. More preferably, the majority of $R_2$ is selected from the group consisting of fatty acyls containing at least 90% $C_{18}$, $C_{22}$ and mixtures thereof.

Other types of suitable quaternary ammonium compounds are described in European Patent No. 0 688 901 A2, assigned to Kimberly-Clark Corporation, published Dec. 12, 1995, and incorporated herein by reference.

Tertiary amine softening compounds can also be used in the present invention. Examples of suitable tertiary amine softeners are described in U.S. Pat. No. 5,399,241, assigned to James River Corporation, issued Mar. 21, 1995, and incorporated herein by reference.

C) Absorbency Additives

If an absorbency aid is desired that enhances the rate of absorbency it can be chosen from the following group of chemicals: polyethoxylates (such as PEG 400); alkyl ethoxylated esters (such as PEGOSPERSE 200 ML from Lonza Inc.); alkyl ethoxylated alcohols (such as Neodol); alkyl polyethoxylated nonylphenols (such as IGEPAL CO produced by Rhone-Poulenc/GAF), ethoxylate trimethyl pentanediol, and/or materials described in U.S. Pat. Nos. 4,959,125 and 4,940,513 issued to Spendel and incorporated herein by reference. In those instances where the surfactant debonder softener decreases wetting, a wetting agent, e.g., a second surfactant, may be added to the application solution. For example, a sorbitan stearate ester can be mixed with an alkyl polyethoxylated alcohol to produce a soft wettable paper.

Water soluble polyhydroxy compounds can also be used as absorbency aids and/or wetting agents. Examples of water soluble polyhydroxy compounds suitable for use in the present invention include glycerol, polyglycerols having a weight average molecular weight of from about 150 to about 800 and polyoxyethylene and polyoxypropylene having a weight-average molecular weight of from about 200 to about 4000, preferably from about 200 to about 1000, most preferably from about 200 to about 600. Polyoxyethylene having an weight average molecular weight of from about 200 to about 600 are especially preferred. Mixtures of the above-described polyhydroxy compounds may also be used. For example, mixtures of glycerol and polyglycerols, mixtures of glycerol and polyoxyethylenes, mixtures of polyglycerols and polyoxyethylenes, etc. . . are useful in the present invention. A particularly preferred polyhydroxy compound is polyoxyethylene having an weight average molecular weight of about 400. This material is available commercially from the Union Carbide Company of Danbury, Conn. under the trade name "PEG-400".

If an absorbency aid is desired that decreases the rate of absorbency it can be chosen from the following group of chemicals. Alkylketenedimers (such as AQUAPELR 360XC Emulsion manufactured by Hercules Inc., Wilmington, Del.); fluorocarbons (such as Scotch Guard by 3M of Minneapolis, Minn.) hydrophobic silicones (such as PDMS DC-200 by Dow Coirning of Midland, Mich.), fluorotelomers (such as ZONYL 7040 by Dupont of Wilmington, Del.), etc.

The absorbency additive can be used alone or in combination with a strength additive. Starch based strength additives have been found to be the preferred binder for use in the present invention. Preferably, the tissue paper is treated with an aqueous solution of starch. In addition to reducing linting of the finished tissue paper product, low levels of starch also imparts a modest improvement in the tensile strength of tissue paper without imparting boardiness (i.e., stiffness) which would result from additions of high levels of starch. Also, this provides tissue paper having improved strength/softness relationship compared to tissue paper which has been strengthened by traditional methods of increasing tensile strength: for example, sheets having increased tensile strength due to increased refining of the pulp; or through the addition of other dry strength additives. This result is especially surprising since starch has traditionally been used to build strength at the expense of softness in applications wherein softness is not an important characteristic: for example, paperboard. Additionally, parenthetically, starch has been used as a filler for printing and writing paper to improve surface printability.

D) Aesthetic Additives

If an aesthetic additive is desired, it can be chosen from the following group of chemicals: inks; dyes; perfumes; opacifiers (such as $TiO_2$ or calcium carbonate), optical brighteners, and mixtures thereof.

The aesthetics of the paper can also be improved utilizing the process described in this invention. Inks, dyes, and/or perfumes are preferably added to the aqueous composition which is subsequently applied to the tissue paper web. The aesthetics additive may be applied alone or in combination with the wetting, softening, and/or strength additives.

Analytical Methods

Analysis of the amounts of treatment chemicals herein retained on tissue paper webs can be performed by any method accepted in the applicable art. For example, the level of polysiloxane retained by the tissue paper can be determined by solvent extraction of the polysiloxane with an organic solvent followed by atomic absorption spectroscopy to determine the level of silicon in the extract; the level of nonionic surfactants, such as alkylglycosides, can be determined by extraction in an organic solvent followed by gas chromatography to determine the level of surfactant in the extract; the level of anionic surfactants, such as linear alkyl sulfonates, can be determined by water extraction followed by colorimetry analysis of the extract; the level of starch can be determined by amylase digestion of the starch to glucose followed by colorimetry analysis to determine glucose level. These methods are exemplary, and are not meant to exclude other methods which may be useful for determining levels of particular components retained by the tissue paper.

Hydrophilicity of tissue paper refers, in general, to the propensity of the tissue paper to be wetted with water. Hydrophilicity of tissue paper may be somewhat quantified by determining the period of time required for dry tissue paper to become completely wetted with water. This period of time is referred to as "wetting time." In order to provide a consistent and repeatable test for wetting time, the following procedure may be used for wetting time determinations: first, a conditioned sample unit sheet (the environmental conditions for testing of paper samples are 23°±1° C. and 50±2% RH as specified in TAPPI Method T 402), approximately 4⅜ inch×4¾ inch (about 11.1 cm×12 cm) of tissue paper structure is provided; second, the sheet is folded into four (4) juxtaposed quarters, and then crumpled into a ball approximately 0.75 inches (about 1.9 cm) to about 1 inch (about 2.5 cm) in diameter; third, the balled sheet is placed on the surface of a body of distilled water at 23°±1° C. and a timer is simultaneously started; fourth, the timer is stopped and read when wetting of the balled sheet is completed. Complete wetting is observed visually.

The preferred hydrophilicity of tissue paper depends upon its intended end use. It is desirable for tissue paper used in a variety of applications, e.g., toilet paper, to completely wet in a relatively short period of time to prevent clogging once the toilet is flushed. Preferably, wetting time is 2 minutes or less. More preferably, wetting time is 30 seconds or less. Most preferably, wetting time is 10 seconds or less.

Hydrophilicity characters of tissue paper embodiments of the present invention may, of course, be determined immediately after manufacture. However, substantial increases in hydrophobicity may occur during the first two weeks after the tissue paper is made: i.e., after the paper has aged two (2) weeks following its manufacture. Thus, the above stated wetting times are preferably measured at the end of such two week period. Accordingly, wetting times measured at the end of a two week aging period at room temperature are referred to as "two week wetting times."

The density of tissue paper, as that term is used herein, is the average density calculated as the basis weight (mass/unit area) of that paper divided by the caliper, with the appropriate unit conversions incorporated therein. Caliper of the tissue paper, as used herein, is the thickness of the paper when subjected to a compressive load of 95 $g/in^2$ (15.5 $g/cm^2$). A suitable instrument for measurement is the thickness tester model 89–100 made by Twing-Albert Instrument Co. of Philadelphia, Pa., 19154.

The following examples illustrate the practice of the present invention but are not intended to be limiting thereof.

EXAMPLE 1

A pilot scale Fourdrinier papermaking machine is used in the practice of the present invention. A 3% by weight aqueous slurry of NSK (Northern Softwood Kraft (such as Grand Prairie from Weyerhaeuser Corporation of Tacoma Wash.)) is made up in a conventional re-pulper. A 2% solution of the temporary wet strength resin (i.e., National starch 78-0080 marketed by National Starch and Chemical corporation of New-York, N.Y.) is added to the NSK stock pipe at a rate of 0.75% by weight of the dry fibers. The adsorption of the temporary wet strength resin onto NSK fibers is enhanced by an in-line mixer. The NSK slurry is diluted to about 0.2% consistency at the fan pump. A 3% by weight aqueous slurry of Eucalyptus (such as Aracruz of Brazil) fibers is made up in a conventional re-pulper. The Eucalyptus slurry is diluted to about 0.2% consistency at the fan pump. The individual furnish components are sent to separate layers (i.e., Euc. to the outer layers and NSK in the center layer) in the head box and deposited onto a Foudrinier wire to form a three-layer embryonic web, wherein each layer is equivalent in basis weight. Dewatering occurs through the Fourdrinier wire and is assisted by a deflector and vacuum boxes. The Fourdrinier wire is of a 5-shed, satin weave configuration having 33 machine-direction and 30 cross-machine-direction monofilaments per centimeter, respectively. The embryonic wet web is transferred from the Fourdrinier wire, at a fiber consistency of about 18% at the point of transfer, to a second papermaking belt. The second papermaking belt is an endless belt having the preferred network surface and deflection conduits. The papermaking belt is made by forming a photo-polymeric network on a foraminous woven element made of polyester and having 20 (MD) by 18 (CD) filaments per centimeter in a four shed dual layer design according to the process disclosed in U.S. Pat. No. 5,334,289 issued to Trokhan, and incorporated by reference herein. The filaments are about 0.22 mm in diameter machine-direction and 0.28 mm in diameter cross-machine-direction. The photo-polymer fabric has about 35 percent knuckle area and has 562 Linear Idaho Cells per square inch (87 cells per square cm), the Linear Idaho cell pattern is described in detail in FIG. 19 of U.S. Pat. No. 5,514,523, issued to Trokhan et al. on May 7, 1996, and incorporated herein by reference. The photosensitive resin used in the process is MEH-1000, a methacrylated-urethane resin marketed by MacDermid Imaging Technology Inc., Wilmington, Del. The papermaking belt has a total thickness of about 1.2 mm with 0.2 mm of photopolymer pattern extending above the woven foraminous element.

The embryonic web is carried on the papermaking belt past the vacuum dewatering box, through blow-through predryers after which the web is transferred onto a Yankee dryer. The other process and machine conditions are listed below. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray applied by applicators; the fiber consistency is increased to be an estimated 98% before dry creping the web with a doctor blade. The doctor blade has a bevel angle of about 25 degrees and is positioned with respect to the Yankee dryer to provide an impact angle of about 81 degrees; the Yankee dryer is operated at about 350° F. (177° C.); the Yankee dryer is operated at about 800 fpm (feet per minute) (about 244 meters per minute). The dry creped web is then passed between two calender rolls. The two calender rolls are biased together at roll weight and operated at surface speeds of 660 fpm (about 201 meters per minute). The calendered web is wound on a reel (which is also operated at a surface speed of 660 fpm) and is then ready for use.

An aqueous solution containing a chemical additive composition is continuously applied onto the paper-contacting surface of the papermaking belt via an emulsion distribution roll before the papermaking belt comes in contact with the embryonic web. The aqueous chemical additive composition applied by the distribution roll onto the deflection member contains five ingredients: water, Regal Oil (a high-speed turbine oil marketed by the Texaco Oil Company), ADOGEN TA 100 (a distearyldimethyl ammonium chloride surfactant marketed by the Witco Corporation, cetyl alcohol (a $C_{16}$ linear fatty alcohol marketed by The Procter & Gamble Company) and glycerol. The relative proportions of the five ingredients are as follows: 6.1% by weight Regal Oil, 0.3% by weight Adogen, 0.2% by weight cetyl alcohol, 31.1% by weight of glycerol, and the remainder water. The volumetric flow rate of the aqueous chemical additive composition applied to the papermaking belt is about 0.50 gal/hr.-cross-direction ft. (about 6.21 liters/hr-meter). The wet web has a fiber consistency of about 25%, total web weight basis, when it comes in contact with the aqueous chemical additive composition.

The web is converted into a single ply tissue paper product. The tissue paper has about 18 #/3M Sq Ft basis weight, contains about 1% of the glycerol and about 1% of the Regal oil primarily on the knuckle areas of the tissue paper, and about 0.2% of the temporary wet strength resin distributed throughout the tissue paper. Importantly, the resulting tissue paper is soft, absorbent and is suitable for use as facial and/or toilet tissues.

EXAMPLE 2

A pilot scale Fourdrinier papermaking machine is used in the practice of the present invention. A 3% by weight aqueous slurry of NSK (Northern Softwood Kraft (such as Grand Prairie from Weyerhaeuser Corporation of Tacoma Wash.)) is made up in a conventional re-pulper. A 2% solution of the temporary wet strength resin (i.e., National starch 78-0080 marketed by National Starch and Chemical corporation of New-York, N.Y.) is added to the NSK stock pipe at a rate of 0.75% by weight of the dry fibers. The adsorption of the temporary wet strength resin onto NSK fibers is enhanced by an in-line mixer. The NSK slurry is diluted to about 0.2% consistency at the fan pump. A 3% by weight aqueous slurry of Eucalyptus (such as Aracruz of Brazil) fibers is made up in a conventional re-pulper. The Eucalyptus slurry is diluted to about 0.2% consistency at the fan pump. The individual furnish components are sent to separate layers (i.e., Euc. to the outer layers and NSK in the center layer) in the head box and deposited onto a Foudrinier wire to form a three-layer embryonic web. Dewatering occurs through the Fourdrinier wire and is assisted by a deflector and vacuum boxes. The Fourdrinier wire is of a 5-shed, satin weave configuration having 33 machine-direction and 30 cross-machine-direction monofilaments per centimeter, respectively. The embryonic wet web is transferred from the Fourdrinier wire, at a fiber consistency of about 18% at the point of transfer, to a second papermaking belt. The second papermaking belt is an endless belt having the preferred network surface and deflection conduits. The papermaking belt is made by forming a photopolymeric network on a foraminous woven element made of polyester and having 20 (MD) by 18 (CD) filaments per centimeter in a four shed dual layer design according to the process disclosed in U.S. Pat. No. 5,334,289 issued to Trokhan, and incorporated by reference herein. The filaments are about 0.22 mm in diameter machine-direction and 0.28 mm in diameter cross-machine-direction. The photo-polymer fabric has about 35 percent knuckle area and has 562 Linear Idaho Cells per square inch (87 cells per square cm), the Linear Idaho cell pattern is described in detail in FIG. 19 of U.S. Pat. No. 5,514,523, issued to Trokhan et al. on May 7, 1996, and incorporated herein by reference. The photosensitive resin used in the process is MEH-1000, a methacrylated-urethane resin marketed by MacDermid Imaging Technology Inc., Wilmington, Del. The papermaking belt has a total thickness of about 1.2 mm with 0.2 mm of photopolymer pattern extending above the woven foraminous element.

The embryonic web is carried on the papermaking belt past the vacuum dewatering box, through blow-through predryers after which the web is transferred onto a Yankee dryer. The other process and machine conditions are listed below. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray applied by applicators; the fiber consistency is increased to be an estimated 98% before dry creping the web with a doctor blade. The doctor blade has a bevel angle of about 25 degrees and is positioned with respect to the Yankee dryer to provide an impact angle of about 81 degrees; the Yankee dryer is operated at about 350° F. (177° C.); the Yankee dryer is operated at about 800 fpm (feet per minute) (about 244 meters per minute). The dry creped web is then passed between two calender rolls. The two calender rolls are biased together at roll weight and operated at surface speeds of 660 fpm (about 201 meters per minute). The calendered web is wound on a reel (which is also operated at a surface speed of 660 fpm) and is then ready for use.

An aqueous solution containing a chemical additive composition is continuously applied onto the upper portion of the calender rolls. The aqueous chemical additive composition applied by the calender roll contains three ingredients: water, a quartenary ammonium compound (such as di(hydrogenated)tallow dimethyl ammonium methyl sulfate marketed by the Witco Corporation under the trade name "VARISOFT 137" and glycerol. The relative proportions of the three ingredients are as follows: 10% by weight "VARISOFT 137", 40% by weight of glycerol, and the remainder water. The web has a fiber consistency of about 98%, total web weight basis, when it comes in contact with the aqueous chemical additive composition.

The web is converted into a single ply tissue paper product. The tissue paper has about 18 #/3M Sq Ft basis weight, contains about 1% of the glycerol and about 0.2% of the quaternary ammonium compound softener primarily on the pillow areas of the tissue paper, and about 0.2% of the temporary wet strength resin distributed throughout the tissue paper. Importantly, the resulting tissue paper is soft, absorbent and is suitable for use as facial and/or toilet tissues.

EXAMPLE 3

A pilot scale Fourdrinier papermaking machine is used in the practice of the present invention. A 3% by weight aqueous slurry of NSK (Northern Softwood Kraft (such as Grand Prairie from Weyerhaeuser Corporation of Tacoma Wash.)) is made up in a conventional re-pulper. A 2% solution of the temporary wet strength resin (i.e., National starch 78-0080 marketed by National Starch and Chemical corporation of New-York, N.Y.) is added to the NSK stock pipe at a rate of 0.75% by weight of the dry fibers. The adsorption of the temporary wet strength resin onto NSK fibers is enhanced by an in-line mixer. The NSK slurry is diluted to about 0.2% consistency at the fan pump. A 3% by weight aqueous slurry of Eucalyptus (such as Aracruz of Brazil) fibers is made up in a conventional re-pulper. The Eucalyptus slurry is diluted to about 0.2% consistency at the fan pump. The individual furnish components are sent to separate layers (i.e., Euc. to the outer layers and NSK in the center layer) in the head box and deposited onto a Foudrinier wire to form a three-layer embryonic web. Dewatering occurs through the Fourdrinier wire and is assisted by a deflector and vacuum boxes. The Fourdrinier wire is of a 5-shed, satin weave configuration having 33 machine-direction and 30 cross-machine-direction monofilaments per centimeter, respectively. The embryonic wet web is transferred from the Fourdrinier wire, at a fiber consistency of about 18% at the point of transfer, to a second papermaking belt. The second papermaking belt is an endless belt having the preferred network surface and deflection conduits. The papermaking belt is made by forming a photopolymeric network on a foraminous woven element made of polyester and having 20 (MD) by 18 (CD) filaments per centimeter in a four shed dual layer design according to the process disclosed in U.S. Pat. No. 5,334,289 issued to Trokhan, and incorporated by reference herein. The filaments are about 0.22 mm in diameter machine-direction and 0.28 mm in diameter cross-machine-direction. The photo-polymer fabric has about 35 percent knuckle area and has 562 Linear Idaho Cells per square inch (87 cells per square cm), the Linear Idaho cell pattern is described in detail in FIG. 19 of U.S. Pat. No. 5,514,523, issued to Trokhan et al. on May 7, 1996, and incorporated herein by reference. The photosensitive resin used in the process is MEH-1000, a methacrylated-urethane resin marketed by MacDermid Imaging Technology Inc., Wilmington, Del. The papermaking belt has a total thickness of about 1.2 mm with 0.2 mm of photopolymer pattern extending above the woven foraminous element.

The embryonic web is carried on the papermaking belt past the vacuum dewatering box, through blow-through predryers after which the web is transferred onto a Yankee dryer. The other process and machine conditions are listed below. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray applied by applicators; the fiber consistency is increased to be an estimated 98% before dry creping the web with a doctor blade. The doctor blade has a bevel angle of about 25 degrees and is positioned with respect to the Yankee dryer to provide an impact angle of about 81 degrees; the Yankee dryer is operated at about 350° F. (177° C.); the Yankee dryer is operated at about 800 fpm (feet per minute) (about 244 meters per minute). The dry creped web is then passed between two calender rolls. The two calender rolls are biased together at roll weight and operated at surface speeds of 660 fpm (about 201 meters per minute). The calendered web is wound on a reel (which is also operated at a surface speed of 660 fpm) and is then ready for use.

An aqueous solution containing a chemical additive composition is continuously applied onto the knuckle areas of the papermaking belt via an emulsion distribution roll before the papermaking belt comes in contact with the embryonic web. The aqueous chemical additive composition applied by the distribution roll onto the knuckle areas of the papermaking belt contains five ingredients: water, Regal Oil (a high-speed turbine oil marketed by the Texaco Oil Company), ADOGEN TA 100 (a distearyidimethyl ammonium chloride surfactant marketed by the Witco Corporation, cetyl alcohol (a $C_{16}$ linear fatty alcohol marketed by The Procter & Gamble Company) and a water soluble dye composition. The relative proportions of the five ingredients are as follows: 6.1% by weight Regal Oil, 0.3% by weight Adogen, 0.2% by weight cetyl alcohol, 0.2% by weight of water soluble dye composition, and the remainder water. The volumetric flow rate of the aqueous chemical additive composition applied to the papermaking belt is about 0.50 gal/hr.-cross-direction ft. (about 6.21 liters/hr-meter). The wet web has a fiber consistency of about 25%, total web weight basis, when it comes in contact with the aqueous chemical additive composition.

The web is converted into a single ply tissue paper product. The tissue paper has about 18 #/3M Sq Ft basis weight and contains about 0.2% of a temporary wet strength resin. Importantly, the resulting tissue paper is soft, absorbent, has improved aesthetics and is suitable for use as facial and/or toilet tissues.

EXAMPLE 4

A pilot scale Fourdrinier papermaking machine is used in the practice of the present invention. A 3% by weight aqueous slurry of NSK (Northern Softwood Kraft (such as Grand Prairie from Weyerhaeuser Corporation of Tacoma Wash.) is made up in a conventional re-pulper. A 2% solution of the temporary wet strength resin (i.e., National STARCH 78-0080 marketed by National Starch and Chemical corporation of New-York, N.Y.) is added to the NSK stock pipe at a rate of 0.75% by weight of the dry fibers. The adsorption of the temporary wet strength resin onto NSK fibers is enhanced by an in-line mixer. The NSK slurry is diluted to about 0.2% consistency at the fan pump. A 3% by weight aqueous slurry of Eucalyptus (such as Aracruz of Brazil) fibers is made up in a conventional re-pulper. The Eucalyptus slurry is diluted to about 0.2% consistency at the fan pump. The individual furnish components are sent to separate layers (i.e., Euc. to the outer layers and NSK in the center layer) in the head box and deposited onto a Foudrinier wire to form a three-layer embryonic web. Dewatering occurs through the Fourdrinier wire and is assisted by a deflector and vacuum boxes. The Fourdrinier wire is of a 5-shed, satin weave configuration having 33 machine-direction and 30 cross-machine-direction monofilaments per centimeter, respectively. The embryonic wet web is transferred from the Fourdrinier wire, at a fiber consistency of about 18% at the point of transfer, to a second papermaking belt. The second papermaking belt is an endless belt having the preferred network surface and deflection conduits. The papermaking belt is made by forming a photopolymeric network on a foraminous woven element made of polyester and having 20 (MD) by 18 (CD) filaments per centimeter in a four shed dual layer design according to the process disclosed in U.S. Pat. No. 5,334,289 issued to Trokhan, and incorporated by reference herein. The filaments are about 0.22 mm in diameter machine-direction and 0.28 mm in diameter cross-machine-direction. The photo-polymer fabric has about 35 percent knuckle area and has 562 Linear Idaho Cells per square inch (87 cells per square cm), the Linear Idaho cell pattern is described in detail in FIG. 19 of U.S. Pat. No. 5,514,523, issued to Trokhan et al. on May 7, 1996, and incorporated herein by reference. The photosensitive resin used in the process is MEH-1000, a methacrylated-urethane resin marketed by MacDermid Imaging Technology Inc., Wilmington, Del. The papermaking belt has a total thickness of about 1.2 mm with 0.2 mm of photopolymer pattern extending above the woven foraminous element.

The embryonic web is carried on the papermaking belt past the vacuum dewatering box, through blow-through predryers after which the web is transferred onto a Yankee dryer. The other process and machine conditions are listed below. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray applied by applicators; the fiber consistency is increased to be an estimated 98% before dry creping the web with a doctor blade. The doctor blade has a bevel angle of about 25 degrees and is positioned with respect to the Yankee dryer to provide an impact angle of about 81 degrees; the Yankee dryer is operated at about 350° F. (177° C.); the Yankee dryer is operated at about 800 fpm (feet per minute) (about 244 meters per minute). The dry creped web is then passed between two calender rolls. The two calender rolls are biased together at roll weight and operated at surface speeds of 660 fpm (about 201 meters per minute). The calendered web is wound on a reel (which is also operated at a surface speed of 660 fpm) and is then ready for use.

An aqueous solution containing a chemical additive composition is continuously applied to the surface of the Yankee dryer by a spray system prior to the transfer of the embryonic web. The aqueous chemical additive composition applied by the spray system onto the surface of the Yankee dryer contains three ingredients: water, AIRVOL 540 (a polyvinyl alcohol marketed by Air Products and Chemicals of Allentown, Pa.) and CYPRO 711 (a polyacrylamid dry strength resin supplied by American Cyanamid of Wayne, N.J.). The relative proportions of the three ingredients are as follows: 0.125% by weight polyvinyl alcohol, 0.125% by weight polyacrylamid dry strength resin, and the remainder water. The volumetric flow rate of the aqueous chemical additive composition applied to the surface of the Yankee Dryer is about 0.11 gallons/minute/cross direction foot. The wet embryonic web has an overall average water content of about 0.67 pounds of water per pound of fiber.

The web is converted into a single ply tissue paper product. The tissue paper has a basis weight of about 18 pounds of fiber per 3000 square feet of area and contains about 0.01% of the dry strength resin distributed primarily on the low elevation regions of the tissue product. Importantly, the resulting tissue paper is soft, absorbent, has improved aesthetics and is suitable for use as facial and/or toilet tissues.

What is claimed is:

1. A chemically enhanced paper structure comprising:

a macroscopically monoplanar cellulosic substrate having two elevations, a first elevation defining a first pattern and a second elevation defining a second pattern, said second pattern comprising a plurality of discrete domes extending outwardly from said first elevation, wherein each said elevation comprises one or more regions; and an immobilized chemical papermaking additive disposed on one of said regions corresponding to one of said elevations of said cellulosic substrate, said regions of said other elevation being free of said additive.

2. A chemically enhanced paper structure according to claim 1 wherein one of said elevations corresponds to discrete regions and the other of said elevations corresponds to an essentially continuous network.

3. A chemically enhanced paper structure according to claim 2 wherein said immobilized chemical papermaking additive is disposed on said discrete regions.

4. A chemically enhanced paper structure according to claim 2 made according to the method comprising the step of printing said chemical papermaking additive onto one of said regions by contact with a roll.

5. A chemically enhanced paper structure according to claim 1 wherein said chemical papermaking additive is selected from the group consisting of strength additives, absorbency additives, softener additives, aesthetic additives, and mixtures thereof.

6. A chemically enhanced paper structure according to claim 5 wherein said chemical papermaking additive is a softener additive.

7. A chemically enhanced paper structure according to claim 6 wherein said softener additive is selected from the group consisting of lubricants, plasticizers, cationic debonders, noncationic debonders, and mixtures thereof.

8. A chemically enhanced paper structure according to claim 7 wherein said lubricant additive comprises a silicone compound.

9. A chemically enhanced paper structure according to claim 8 wherein said silicone compound is an amino functional silicone.

10. A chemically enhanced paper structure according to claim 7 wherein said softener additive is a noncationic debonder.

11. A chemically enhanced paper structure according to claim 10 wherein said noncationic debonder is selected from the group consisting of sorbitan esters, ethoxylated sorbitan esters, propoxylated sorbitan esters, mixed ethoxylated/propoxylated sorbitan esters, and mixtures thereof.

12. A chemically enhanced paper structure according to claim 7 wherein said debonder additive is a cationic softener.

13. A chemically enhanced paper structure according to claim 12 wherein said cationic debonder is a quaternary ammonium compound.

14. A chemically enhanced paper structure according to claim 12 wherein said cationic debonder is a diester quaternary ammonium compound.

15. A chemically enhanced paper structure according to claim 5 wherein said chemical papermaking additive is a strength additive.

16. A chemically enhanced paper structure according to claim 15 wherein said strength additive is selected from the group consisting of permanent wet strength resins, temporary wet strength resins, dry strength additives, and mixtures thereof.

17. A chemically enhanced paper structure according to claim 16 wherein said strength additive is a permanent wet strength resin selected from the group consisting of polyamide-epichlorohydrin resin, polacrylamide resin, and mixtures thereof.

18. A chemically enhanced paper structure according to claim 16 wherein said strength additive is a starch-based temporary wet strength resin.

19. A chemically enhanced paper structure according to claim 5 wherein said chemical papermaking additive is an absorbency additive.

20. A chemically enhanced paper structure according to claim 19 wherein said absorbency additive is selected from the group consisting of polyhydroxy compounds, polyethoxylates, alkylethoxylated esters, alkylethoxylated alcohols, alkylpolyethoxylated nonylphenols, ethoxylate trimethyl pentanediol, and mixtures thereof.

21. A chemically enhanced paper structure according to claim 20 wherein said absorbency additive is an alkyl ethoxylated alcohol.

22. A chemically enhanced paper structure according to claim 20 wherein said absorbency additive is a polyhydroxy compound.

23. A chemically enhanced paper structure according to claim 22 wherein said polyhydroxy compound is selected from the group consisting of glycerol, polyglycerol, polyoxyethylene, polyoxypropylene, and mixtures thereof.

24. A chemically enhanced paper structure according to claim 5 wherein said chemical papermaking additive is an aesthetic additive.

25. A chemically enhanced paper structure according to claim 24 wherein said aesthetic additive is selected from the group consisting of inks, dyes, perfumes, opacifiers, optical brighteners, and mixtures thereof.

26. A chemically enhanced paper structure according to claim 25 wherein said aesthetic additive is a dye.

27. A chemically enhanced paper structure according to claim 1 made according to the method comprising the step of printing said chemical papermaking additive onto one of said regions by contact with a roll.

28. A through-air-dried chemically enhanced paper structure comprising:

a macroscopically monoplanar cellulosic substrate comprising an essentially continuous network region and discrete regions disposed therein, said discrete regions extending outwardly from said essentially continuous network region, said essentially continuous network defining a first elevation and said discrete regions defining a second elevation; and an immobilized chemical papermaking additive disposed on one of said regions corresponding to one of said elevations of said cellulosic substrate, said regions of said other elevation being free of said additive.

29. A chemically enhanced paper structure according to claim 26 made according to the method comprising the step of printing said chemical papermaking additive onto one of said regions by contact with a roll.

* * * * *

UNITED STATES PATENT AND TRADEMARK OFFICE

CERTIFICATE OF CORRECTION

PATENT NO. : 5,840,403

DATED : NOVEMBER 24, 1998

INVENTOR(S) : PAUL DENNIS TROKHAN ET AL.

It is certified that error appears in the above-identified patent and that said Letters Patent is hereby corrected as shown below:

Column 9, line 47 of the issued patent, delete "roil" and insert therefor - roll --.

Column 10, line 20 of the issued patent, delete "polyamidpichlorohydrin" and insert therefor - polyamidepichlorohydrin --.

Column 10, line 21 of the issued patent, delete "ureaormaldehyde'" and insert therefor - ureaformaldehyde --.

Column 10, line 30 of the issued patent, delete "KYMEVE®" and insert therefor - KYMENE® --.

Column 12, line 31 of the issued patent, delete " ethoxylated propoxylated" and insert therefor - ethoxylated/propoxylated --.

Column 21, line 2 of the issued patent, delete "distearyidimethyl" and insert therefor - distearyldimethyl --.

Column 21, line 30 of the issued patent, delete "STARCH" and insert therefor - Starch --.

Signed and Sealed this

Thirty-first Day of August, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,840,403

DATED : NOVEMBER 24, 1998

INVENTOR(S) : PAUL DENNIS TROKHAN ET AL.

It is certified that error appears in the above-identified patent and that said Letters Patent is hereby corrected as shown below:

(1) Column 10, line 22 of the issued patent, delete "Polyamide-epichlorohydrin" and insert therefor - Polyamidepichlorohydrin --.

(2) Column 10, line 28 of the issued patent, delete "polyamide-epichlorohydrin" and insert therefor - polyamidepichlorohydrin --.

Signed and Sealed this

Twenty-fourth Day of October, 2000

*Attest:*

Q. TODD DICKINSON

*Attesting Officer*

*Director of Patents and Trademarks*